United States Patent [19]

Tsuchiya et al.

[11] Patent Number: 4,472,543

[45] Date of Patent: Sep. 18, 1984

[54] FLAME RETARDANT DIAPHRAGM FOR ACOUSTIC TRANSDUCERS

[75] Inventors: Kazuo Tsuchiya; Fumio Kawahara, both of Mamurogawamachi; Shigeru Watanabe, Tendo, all of Japan

[73] Assignees: Pioneer Electronic Corporation, Tokyo; Mogami Denki Kabushiki Kaisha, Yamagata, both of Japan

[21] Appl. No.: 382,461

[22] Filed: May 26, 1982

[30] Foreign Application Priority Data

Jun. 1, 1981 [JP] Japan ..... 56-82552

[51] Int. Cl.[3] ..... H04R 7/00

[52] U.S. Cl. ..... 523/446; 181/169; 523/460; 523/462; 524/14; 524/101; 524/341

[58] Field of Search ..... 181/169; 523/446, 460, 523/462; 524/14, 101, 341

[56] References Cited

U.S. PATENT DOCUMENTS

| | | | |
|---|---|---|---|
| 3,280,216 | 10/1966 | Partansky | 523/460 |
| 3,798,057 | 3/1974 | Polovina | 523/462 |
| 3,907,063 | 9/1975 | Nakazawa et al. | 181/169 |
| 3,930,130 | 12/1975 | Boszor | 181/169 |
| 4,107,230 | 8/1978 | Turnbo et al. | 523/462 |
| 4,282,136 | 8/1981 | Hunt et al. | 523/460 |
| 4,331,780 | 5/1982 | Brady | 524/101 |

FOREIGN PATENT DOCUMENTS 1452118 10/1976 United Kingdom .

*Primary Examiner*—Veronica P. Hoke

*Attorney, Agent, or Firm*—Shlesinger, Arkwright, Garvey & Fado

[57] ABSTRACT

A flame retardant diaphragm for speakers, etc. comprises an admixture of natural fibers and inorganic fibers. The admixture is impregnated with a thermosetting resin and an organic bromine compound, and heat-treated under pressure. The organic bromine compound acts as a flame retarder.

10 Claims, 1 Drawing Figure

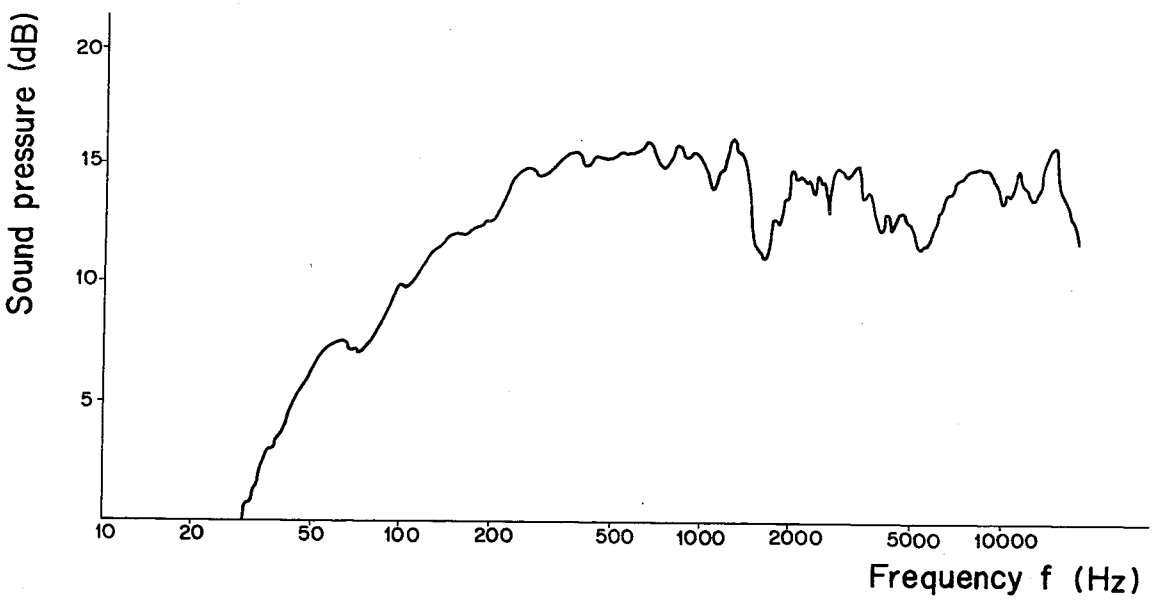
Sound pressure (dB)
20
15
10
5
10
20
50
100
200
500
1000
2000
5000
10000
Frequency f (Hz)

FLAME RETARDANT DIAPHRAGM FOR ACOUSTIC TRANSDUCERS

BACKGROUND OF THE INVENTION

The present invention relates to a diaphragm used with acoustic transducers such as speakers, microphones and the like.

The diaphragm of this type now on the market has been formed of natural fibers by known paper making processes, and enjoyed wide use due to its small mass, relatively large modulus of longitudinal elasticity (a Young's modulus), properly large internal loss, etc. To add to this, the said diaphragm can easily be formed into any complicated shape by the paper making processes.

The diaphragm formed of natural fibers, e.g., wood pulp fibers or strip-like materials, excels in various properties as mentioned above; however, there is now an increasing demand for a new version of diaphragms which are formed of another material capable of producing sounds of different tone quality, adapted to changes in life style and the preference of audio fans. To meet such a demand, the use of thermoplastic or thermosetting resins, e.g., polyvinyl chloride or polyamide, has been proposed. However, the products formed of these resins have the disadvantages that most of them are virtually combustible and, hence, liable to catch fire. With speakers or the like parts, their voice coils may generate heat due to excessive inputs, or may be exposed to high temperatures as is the case with television cabinets. The speakers per se as well as their parts inclusive of diaphragms should thus be made fire retardant.

Inorganic asbestos is a typical example of the flame retardant materials used widely in the art, but is unpreferable in view of tone quality, and is deficient in sensitivity due to its large mass. Furthermore, the asbestos shows a low degree of internal loss, and tends to give rise to high frequency distortion and, hence, fluctuations in the frequency properties, especially in high-pitched sound regions.

SUMMARY OF THE INVENTION

A main object of the present invention is therefore to provide a solution to the above-mentioned problems.

According to the present invention, this object is achieved by the provision of a flame retardant diaphragm characterized in that an admixture of natural fibers and inorganic fibers is impregnated with a thermosetting resin and an organic bromine compound, and heat-treated under pressure.

More specifically, the present invention takes advantage of a diaphragm composed mainly of natural fibers such as wood pulp fibers, and uses a thermosetting resin and an organic bromine compound acting as a flame retarder to obtain a diaphragm having improved flame retardancy and frequency characterized by heat-treatment under pressure.

Other objects and features of the present invention will become apparent from a reading of the following detailed description and attached drawing showing the frequency characteristics of the diaphragm of the present invention.

DETAILED DESCRIPTION OF THE INVENTION

In the present invention, natural fibers such as wood pulp fibers are properly beaten, and mixed with inorganic fibers such as carbon fibers or glass fibers such that the content of said inorganic fibers ranges from 20 to 50% by weight of the resulting admixture. The admixture is formed into a desired diaphragm cone by any one of the paper making processes. The thus obtained cone was impregnated with a liquid mixture of a thermosetting resin and an organic bromine compound in a mixing ratio of 10:2 to 10:5 in a suitable solvent and then dried, for example, at 100° C. for 5 minutes such that the mixture of said thermosetting resin and organic bromine compound is in the range of 20 to 50% by weight of the resultant flame retardant diaphragm.

Subsequently, the thus pre-dried cone is molded at a temperature of 200° C. and a pressure of 8 $Kg/cm^2$ for 1 minute to obtain a diaphragm having improved heat resistance and frequency characteristics.

The organic bromine compound used in the present invention should be soluble in an organic solvent such as alcohols, benzene, toluene or acetone, and have a melting point of 100° C. or higher and a bromine content of 50% or higher. For example, use is preferably made of AFR 1002 - tris(2,3-dibromopropyl)isocyanurate ($C_{12}H_{15}Br_6N_3O_3$, bromine content: 65.8%) and AFR 1010 - 2,2-bis(4-hydroxy-3,5-dibromophenyl)propane ($C_{15}H_{12}Br_4O_2$, bromine content: 58.8%). AFR 1002 is soluble in methanol, benzene, acetone or the like, while AFR 1010 is soluble in an alcohol, acetone, an ether, or dimethyl formamide or the like.

The thermosetting resin used in the present invention includes an epoxy, melamine or phenol resin soluble in the above-mentioned organic solvents. In the present invention, the thermosetting resin serves to prevent separation of the organic bromine compound acting as the flame retarder, and is important for the preparation of a flame retardant diaphragm excelling in workability and humid resistance. As the epoxy resin, use may be made of a commercially available product, "Epiform K 8247", manufactured by Somal Kogyo Inc. As the phenol resin, one may use "Cemedine No. 105" manufactured by Cemedine Kogyo Inc., and as the melamine resin, one may employ "BECKAMINE RM- N" manufactured by Dai-Nippon Ink Kagaku Kogyo Inc.

In general, the diaphragms for speakers should have a reduced surface density and an increased specific modulus $E/\rho$. In other words, the surface density has to be reduced to decrease the weight of the diaphragm and to increase the sound pressure, while the specific modulus $E/\rho$ has to be increased to enlarge a region in which reciprocating movement of the speaker is permitted. That region is a relatively low-frequency zone in which the diaphragm vibrates in its entirety with its frequency characteristics being flat and its sound distortion being limited. On the other hand, there is a relatively high-frequency zone in which the diaphgram vibrates unevenly with its sound pressure characteristics varying and its sound distortion being marked.

Thus, the reciprocating region of the speaker should preferably be enlarged as broad as possible to improve the performance thereof, and the specific modulus $E/\rho$ of the diphragm should preferably be increased as much as possible, since the frequency f is proportional to the root of the specific modulus $E/\rho$.

According to the present invention, an admixture of natural fibers and inorganic fibers is impregnated with a thermosetting resin and an organic bromine compound, and heat-treated under pressure to obtain a diaphragm. The resulting flame retardant diaphragm is not only different in quality from the conventional diaphragm composed of natural fibers, but does also excel in water resistance and heat resistance. The diaphragm according to the present invention can thus stand up to use at temperatures of as high as 230° C. Based on natural and inorganic fibers, the diaphragm has a small density and a rigidity substantially equal to that of a metallic diaphragm owing to the presence of the thermosetting resin, and excels in frequency properties, especially in dynamic properties due to high specific modulus $E/\rho$.

The present invention will now be elucidated with reference to the following non-restrictive example.

EXAMPLE 71.4% by weight of wood pulp fibers and 8.6% by weight of bast fibers were treated for 60 minutes in a beater, and adjusted to a degree of beating of 25° SR–28° SR. Thereafter, 20% by weight of glass fibers, having a density of 2.45 g/cm$^3$ and a length of 5 mm (a length of from 3 to 10 mm is also acceptable) and being circular in cross section, were charged in the beater. The thus beaten material was formed into a conical shape in a paper machine, and finished in a paper making net. The resulting product was then pressed at a pressure of about 2 Kg/cm$^2$ and, at the same time, dried to form a diaphragm cone. This diaphragm cone is impregnated with a mixed liquid containing 68 parts by weight of a thermosetting resin—"Epiform K 8247:50% by weight plus a setting agent:50% by weight—and 32 parts by weight of AFR1010 in such a manner that it had a resin content of 30% by weight, pre-dried, and treated at a pressure of 8 Kg/cm$^2$ and a temperature of 200° C. for 1 minute to obtain the diaphragm according to the present invention.

Apart from this diaphragm, 50% by weight of wood pulp and 50% by weight of glass fibers were formed into a diaphragm cone without using bast fibers. The diaphragm cone was then treated according to the above-mentioned procedures, thereby forming another diaphragm.

These diaphragms were subjected to combustion testing. As a result, it has been found that they show no sign of catching fire just after removed from flames. This is in agreement with UL 94-V-O.

The following table shows the physical properties of the inventive diaphragms and the prior art diaphragm for the purpose of comparison. The accompanying drawing is a frequency characteristics curve of the inventive diaphragm having a glass fiber content of 20% by weight and a diameter of 10 cm.

TABLE

| Component | Physical properties | | | | |
|---|---|---|---|---|---|
| | Density $\rho$ g/cm$^3$ | Young's modulus E dyne/cm$^2$ $\times 10^{10}$ | Internall Loss tan $\delta$ | Propagation rate $\sqrt{E/\rho}$ cm/sec $\times 10$ | Loss modulus E'' dyne/cm$^2$ $\times 10^3$ |
| Pulp fibers 71.4 % by weight Bast fibers 8.6 % by weight Glass fibers 20.0 % by weight | 1.407 | 11.1 | 0.041 | 2.81 | 45.8 |
| Pulp fibers 50 % by weight Glass fibers 50 % by weight | 1.427 | 10.2 | 0.040 | 2.67 | 40.9 |
| Prior art (paper pulp) | 0.813 | 5.5 | 0.037 | 2.61 | 20.7 |

From the table, it is evident that the inventive diaphragms have a density somewhat smaller than, but a Young's modulus about twice that of the prior art diaphragm. The inventive diaphragms have thus an increased specific modulus $E/\rho(\sqrt{E/\rho}$: propagation rate), so that the number of sharp peaks is reduced as shown the attached drawing, which indicates that the sound distortion is limited, and that the frequency characteristics are further improved. The inventive diaphragms were also subjected to 50 cm-water immersion testing. As a result, it has been found that the diaphragms show no sign of any change with time over a period of 4 weeks, and possess good water resistance.

What is claimed is:

1. A flame retardant diaphragm for acoustic transducers comprising an admixture of natural fibers and inorganic fibers in which the content of said inorganic fibers ranges from 20 to 50 percent by weight of the admixture, said admixture being impregnated with a liquid mixture of a thermosetting resin and an organic bromine compound in which the thermosetting resin used is an epoxy, phenol or melamine resin, and said impregnated admixture then being heat-treated under pressure.

2. A flame retardant diaphragm as claimed in claim 1, in which the natural fibers used are wood pulp fibers and/or bast fibers, and the inorganic fibers used are carbon fibers and/or glass fibers.

3. A flame retardant diaphragm as claimed in claim 1, in which a mixing ratio of said thermosetting resin and said organic bromine compound is in a range of 10:2 to 10:5.

4. A flame retardant diaphragm as claimed in claim 1, in which said mixture of the thermosetting resin and organic bromine compound is in the range of 20 to 50% by weight of the flame retardant diaphragm.

5. A flame retardant diaphragm as claimed in claim 1, in which the organic bromine compound used is soluble in an organic solvent, and has a melting point of 100° C. or higher and a bromine content of 50% or higher.

6. A flame retardant diaphragm as claimed in claim 5, in which the organic bromine compound used is tris (2,3-dibromopropyl)isocyanurate or 2,2-bis(4-hydroxy-3,5-dibromophenyl)propane.

7. A flame retardant diaphragm as claimed in claim 1 wherein said inorganic fibers are glass fibers.

8. A flame retardant diaphragm for acoustic transducers comprising an admixture consisting essentially of natural fibers and inorganic fibers, said natural fibers being selected from the group consisting of wood pulp fibers, bast fibers, and a mixture of wood pulp and bast fibers, said inorganic fibers being selected from the group consisting of carbon fibers, glass fibers and a mixture of carbon and glass fibers, said admixture being impregnated with a liquid mixture of an organic bromine compound and a thermosetting resin in which the thermosetting resin is an epoxy, phenol or melamine resin, and said impregnated admixture then being heat-treated under pressure.

9. A flame retardant diaphragm as claimed in claim 8, in which the organic bromine compound is soluble in an organic solvent, has a melting point of 100° C. or higher, and has a bromine content of 50 percent or higher.

10. A flame retardant diaphragm as claimed in claim 9, in which the organic bromine compound used is tris (2,3-dibromopropyl) isocyanurate or 2,2-bis(4-hydroxy-3,5-dibromophenyl)propane.

* * * * *